US011489295B2

(12) United States Patent
Azad et al.

(10) Patent No.: US 11,489,295 B2
(45) Date of Patent: Nov. 1, 2022

(54) EMI GROUNDING BACK COVER FOR ELECTRICAL CONNECTOR

(71) Applicant: Lear Corporation, Southfield, MI (US)

(72) Inventors: Vikas Azad, New Hudson, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 118 days.

(21) Appl. No.: 17/169,879

(22) Filed: Feb. 8, 2021

(65) Prior Publication Data

US 2022/0255268 A1 Aug. 11, 2022

(51) Int. Cl.

| | |
|---|---|
| ***H01R 13/6593*** | (2011.01) |
| ***H01R 13/6592*** | (2011.01) |
| *H01R 13/52* | (2006.01) |
| *H01R 13/6582* | (2011.01) |
| *H01R 13/6583* | (2011.01) |

(52) U.S. Cl.

CPC ..... *H01R 13/6593* (2013.01); *H01R 13/6592* (2013.01); *H01R 13/5202* (2013.01); *H01R 13/5208* (2013.01); *H01R 13/6582* (2013.01); *H01R 13/6583* (2013.01)

(58) Field of Classification Search

CPC ..... H01R 13/6593; H01R 13/6592; H01R 13/5202; H01R 13/5208; H01R 13/6582; H01R 13/6583

See application file for complete search history.

(56) References Cited

U.S. PATENT DOCUMENTS

| | | | | |
|---|---|---|---|---|
| 9,040,846 | B2 | 5/2015 | Suzuki et al. | |
| 9,337,577 | B1 | 5/2016 | Hitchcock et al. | |
| 2009/0149048 | A1 | 6/2009 | Pavlovic et al. | |
| 2014/0120763 | A1 | 5/2014 | Itsuki et al. | |
| 2020/0176935 | A1* | 6/2020 | Azad | H01R 13/73 |

* cited by examiner

*Primary Examiner* — Abdullah A Riyami

*Assistant Examiner* — Justin M Kratt

(74) *Attorney, Agent, or Firm* — MacMillan, Sobanski & Todd, LLC

(57) ABSTRACT

An electrical connector assembly having a housing and a cover assembly. The housing defines a cable receiving cavity and includes a conductive connector shield extending within a portion of the cavity. The cover assembly has a back cover that includes an end wall that mates with the housing adjacent to the cable receiving cavity; a cable support wall extending from the end wall and defining a cable passage extending through the end wall, with the cable support wall configured to receive a shielded cable therein; and a conductive spring clip fixed to the cable support wall and having a first leg configured to be biased into contact with a conductive ferrule of the shielded cable and a second leg, on an opposed side of the cable support wall, spring biased into contact with the connector shield.

20 Claims, 5 Drawing Sheets

EMI GROUNDING BACK COVER FOR ELECTRICAL CONNECTOR

BACKGROUND OF THE INVENTION

This invention relates to an electrical connector, and more particularly to an electrical connector having electromagnetic interference (EMI) shielding.

Electrical connectors are known that provide shielding and grounding for electrical cables to which they connect. It is desirable to provide such electrical connectors with reliable shielding and grounding while minimizing the number of components to assemble/disassemble and allowing for ease of assembly and disassembly.

SUMMARY OF THE INVENTION

According to an aspect, the invention provides an electrical connector assembly having a housing and a cover assembly. The housing defines a cable receiving cavity and includes a conductive connector shield extending within a portion of the cavity. The cover assembly has a back cover that includes an end wall that mates with the housing adjacent to the cable receiving cavity; a cable support wall extending from the end wall and defining a cable passage extending through the end wall, with the cable support wall configured to receive a shielded cable therein; and a conductive spring clip fixed to the cable support wall and having a first leg configured to be biased into contact with a conductive ferrule of the shielded cable and a second leg, on an opposed side of the cable support wall, spring biased into contact with the connector shield.

According to an aspect, the invention provides an electrical connector assembly including a housing, a shielded cable and a cover assembly. The housing has a cable receiving cavity and includes a conductive connector shield extending within a portion of the cavity. The shielded cable has a conductive shield in contact with a conductive ferrule. The cover assembly has a back cover that includes an end wall that mates with the housing adjacent to the cable receiving cavity; a cable support wall extending from the end wall and defining a cable passage extending through the end wall, with the cable support wall receiving the shielded cable therein; and a conductive spring clip fixed to the cable support wall having a first leg biased into contact with the ferrule and a second leg, on an opposed side of the cable support wall, spring biased into contact with the connector shield.

According to an aspect, the invention provides an electrical connector that provides EMI shielding for removable terminals of shielded cables. The invention allows for ease of assembly and disassembly of the terminals to the electrical connector while assuring that reliable shielding is provided when assembled. Additionally, the assembly and disassembly may be accomplished with a minimal number of components to assemble and disassemble.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
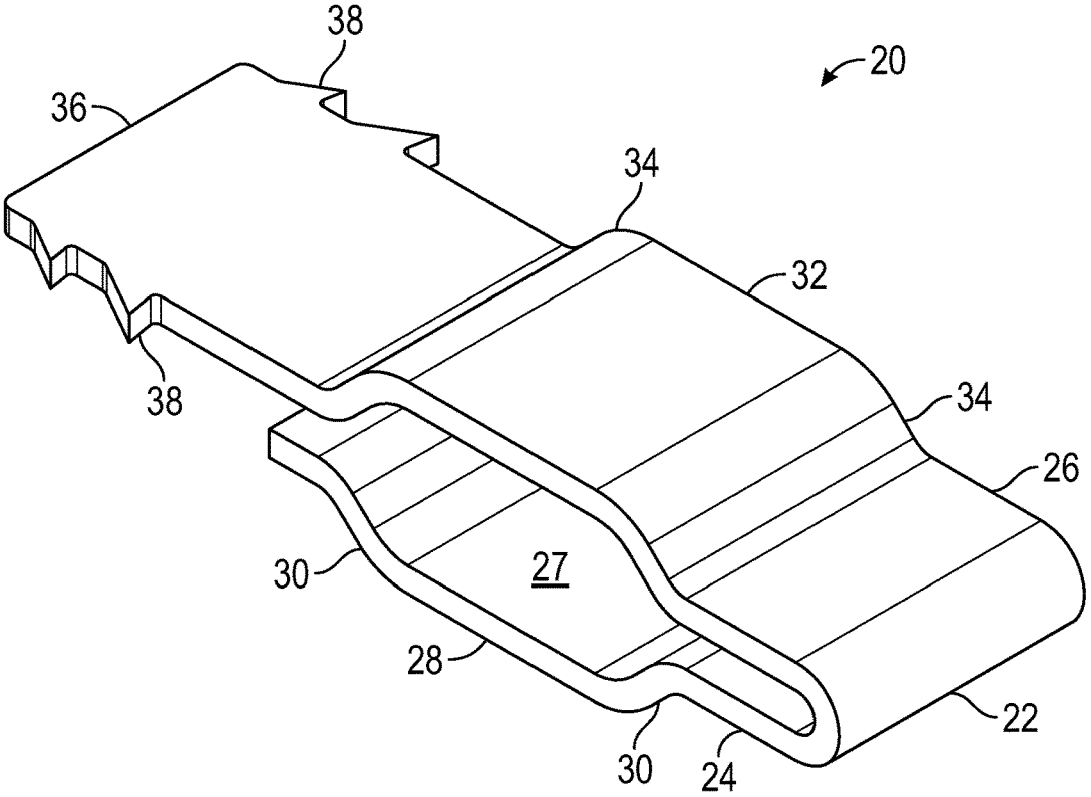
FIG. 1 is a schematic, perspective view of a spring clip.

Referring now to the drawings, there is illustrated in FIG. 1 a grounding spring clip 20, which may be made of metal or other elastically flexible material that is electrically conducting. The spring clip 20 may include an end stop 22, from which two legs, a first leg 24 and a second leg 26, extend generally parallel to each other to form a gap 27. The first leg 24 may include a ferrule contact 28, located between a pair of curved portions 30. The second leg 26 may include a connector shield contact 32, located between a pair of curved portions 34, and a retention arm 36 on a distal end of the second leg 26 from the end stop 22. The retention arm 36 may include retention features 38, which may be for example barbs.

Figure 2:
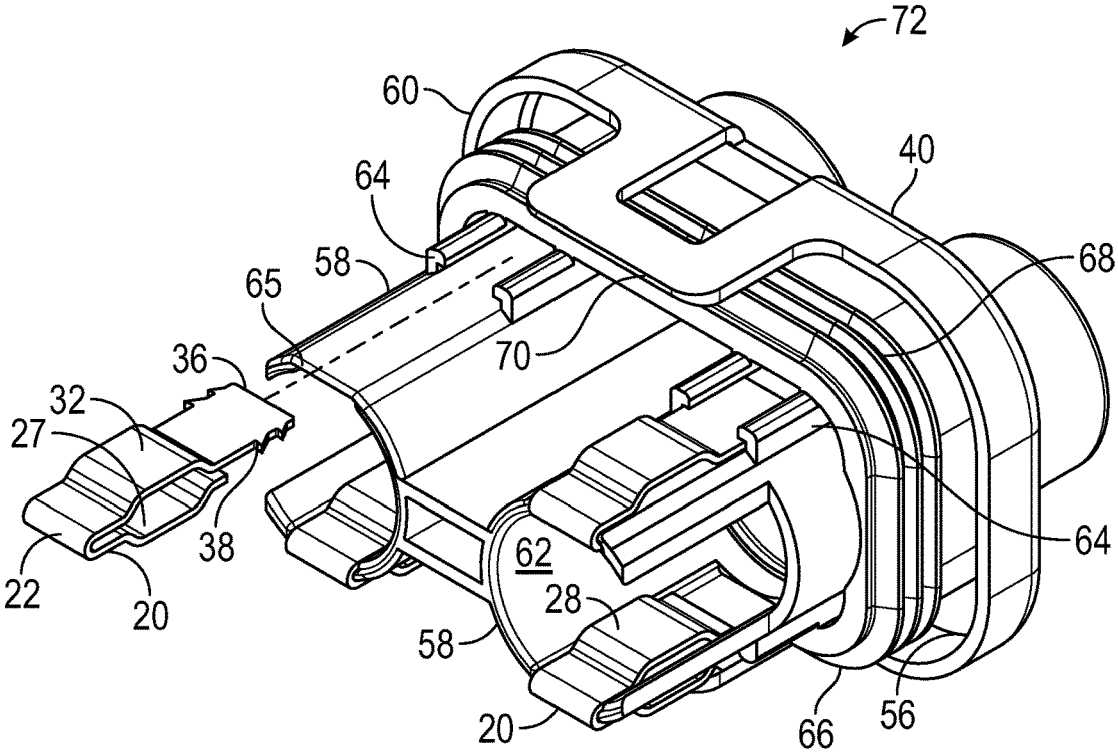
FIG. 2 is a schematic, partially exploded, perspective view of a cover assembly with three of four spring clips mounted on a back cover and a fourth oriented for assembly to the back cover.
Figure 3:
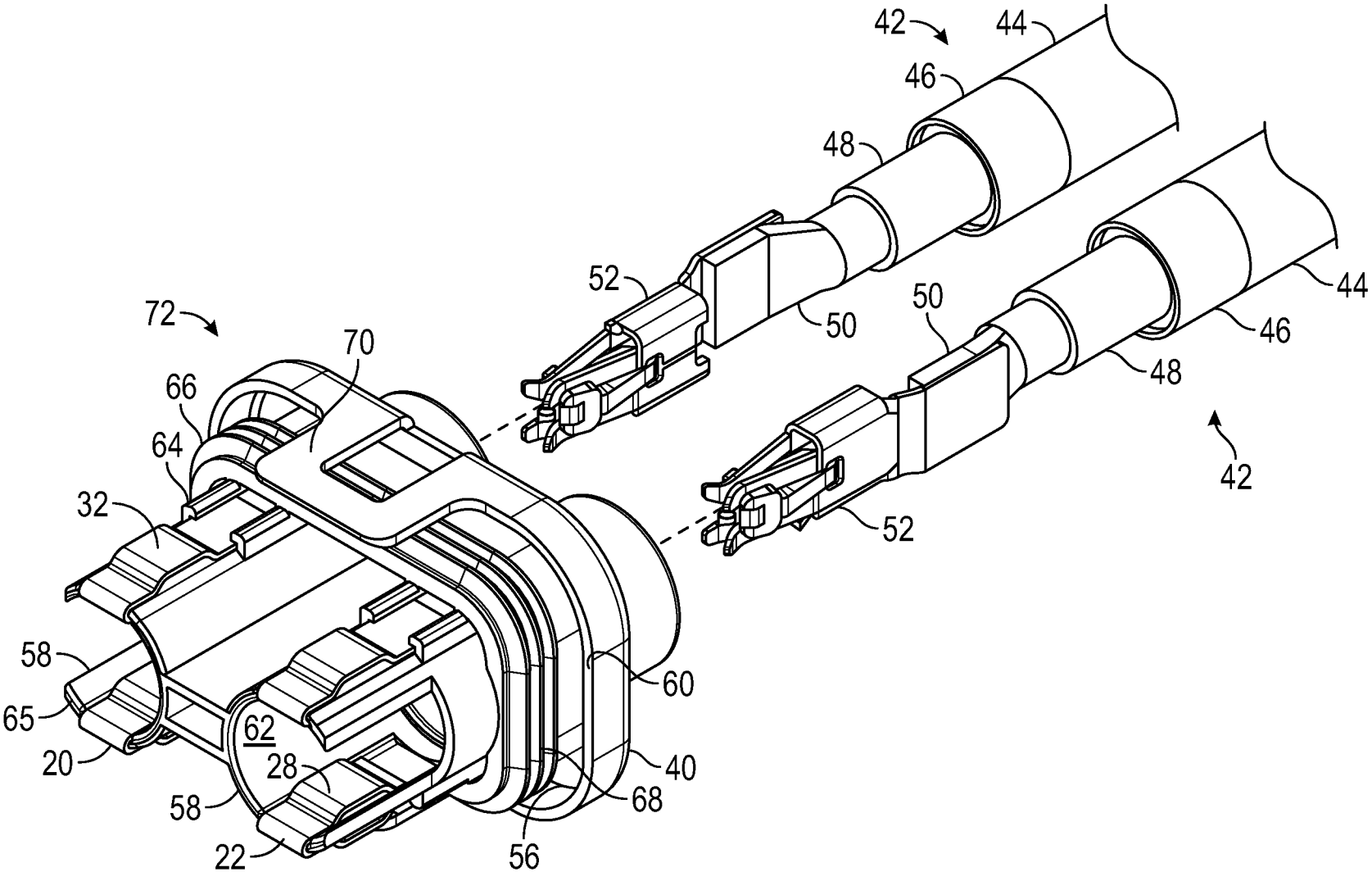
FIG. 3 is a schematic, partially exploded, perspective view of the cover assembly and cable assemblies, which are oriented to be assembled to the cover assembly.
Figure 4:
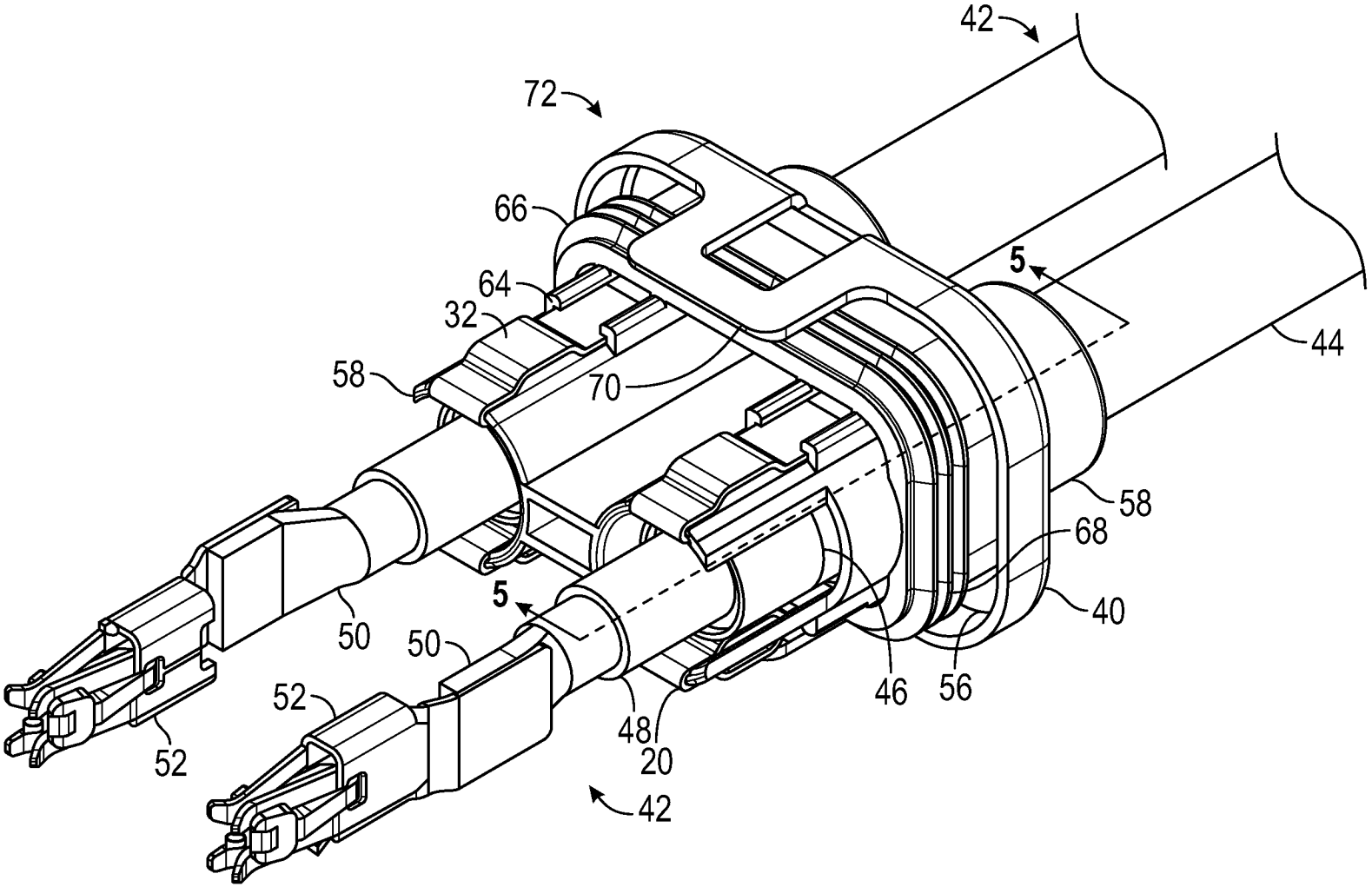
FIG. 4 is a schematic, perspective view of the cover assembly and the cable assemblies in an assembled position.

Referring now to FIGS. 2-4, in view of FIG. 1, a back cover 40 and a pair of cable assemblies 42 are shown. Where elements have already been discussed relative to FIG. 1, the same element numbers will be used in FIGS. 2-4 without repeating the description thereof. While an example of two cable assemblies 42 assembling to a back cover 40 are shown, the back cover 40 can be configured to receive different numbers of cable assemblies 42 without departing from the scope of the present invention.

Each of the cable assemblies 42 may include outer insulation 44, and electrically conductive ferrules 46 extending circumferentially around and in contact with electrically conductive cable shields 48, which extend circumferentially around cables 50. Each cable 50 may be connected to a respective terminal 52.

The back cover 40 may include an end wall 56, from which cable support walls 58 and an alignment flange 60 extend. The cable support walls 58 may define cable passages 62 that extend through the end wall 56, with the cable passages 62 sized to each receive a respective cable assembly 42 therethrough. Each cable support wall 58 may include a pair of clip retention arms 64 extending radially therefrom. Each pair of clip retention arms 64 may be sized and shaped to receive a respective retention arm 36 of respective grounding spring clips 20, with the respective retention features 38 engaging the corresponding retention arms 64 to fix the spring clips 20 to the back cover 40. Each of the spring clips 20, then, may be assembled to the back cover 40 by aligning the retention arm 36 with a corresponding pair of clip retention arms 64 (alignment shown by upper left spring clip 20 in FIG. 2), and telescopically sliding the corresponding cable support wall 58 into the gap 27 of the corresponding spring clip 20 until a receiving end 65 of the cable support wall 58 contacts the end stop 22 (shown by other three spring clips 20 in FIG. 2, as well as spring clips 20 shown in FIGS. 3 and 4). As the retention arm 36 slides between the clip retention arms 64, the retention features 38

(e.g. barbs) engage the clip retention arms 64, thus fixing the spring clip 20 to its corresponding cable support wall 58. The thickness of the cable support walls 58, at the locations where the spring clips 20 slide on, may be about the same thickness or slightly thicker than the thickness of the gaps 27—this snug fit may also assist in maintaining the spring clips 20 in the desired positions on the support walls 58.

The back cover 40 may also include an interface seal 66 extending circumferentially around the cable support walls 58, between the cable support walls 58 and the alignment flange 60. The back cover 40 may be, for example, molded as a plastic part, and the interface seal 66 may be, for example, overmolded to the end wall 56 of the back cover 40. The interface seal 66 may be formed of an elastomeric material that readily allows for elastic flexing of sealing ribs 68. The alignment flange 60 of the back cover 40 may include housing retention flanges 70 that releasably secure the back cover 40 to a connector housing (discussed below). Accordingly, the back cover 40, interface seal 66 and spring clips 20 create a single assembly that can be easily mounted to and removed from a connector housing 78 of an electrical connector 80 as a single unit (cover assembly 72).

Figure 5:
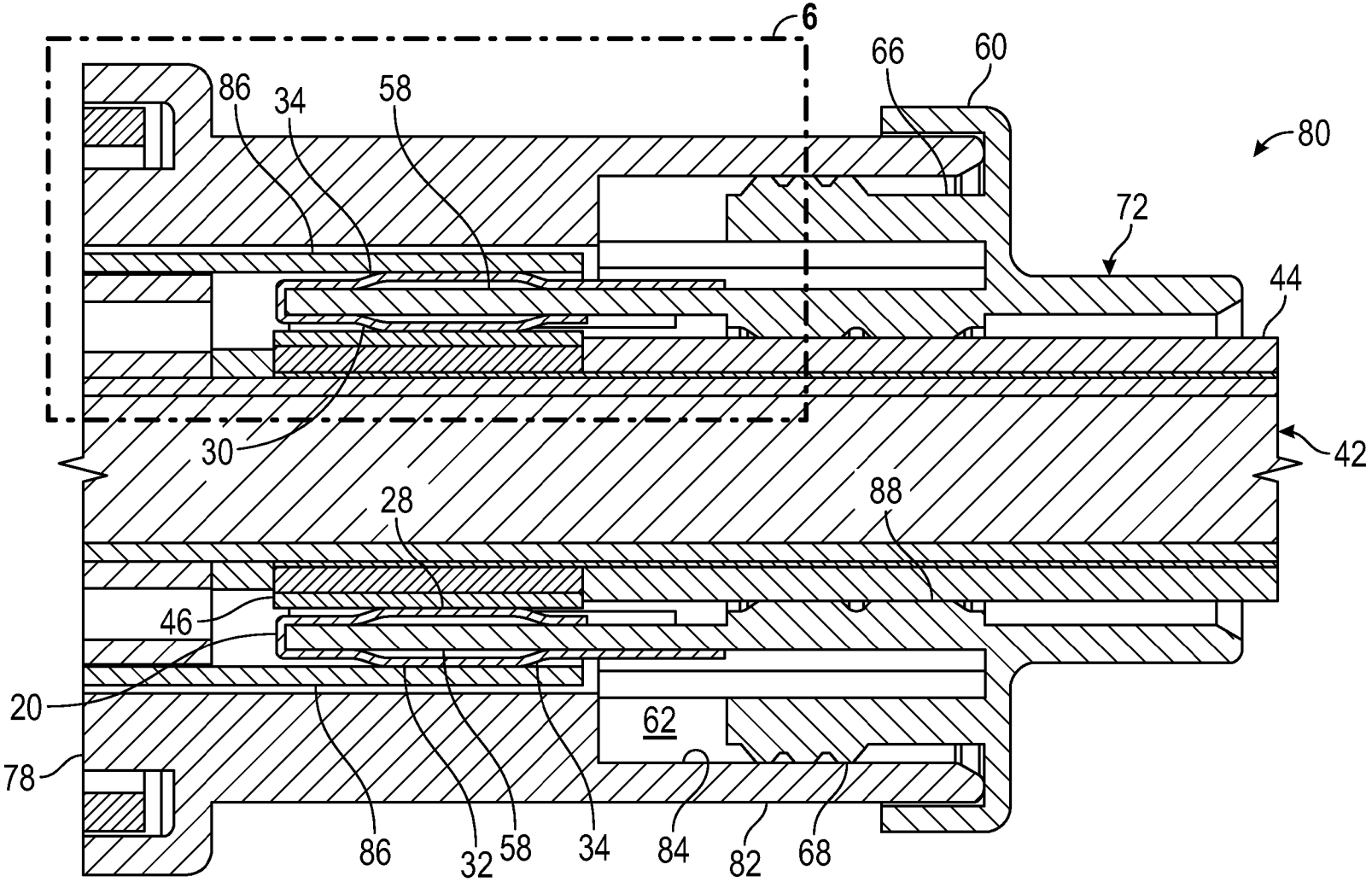
FIG. 5 is a schematic, cross section view, taken along line 5-5 in FIG. 4, of a portion of the cover assembly and the cable assemblies, plus portions of an electrical connector are also shown.
Figure 6:
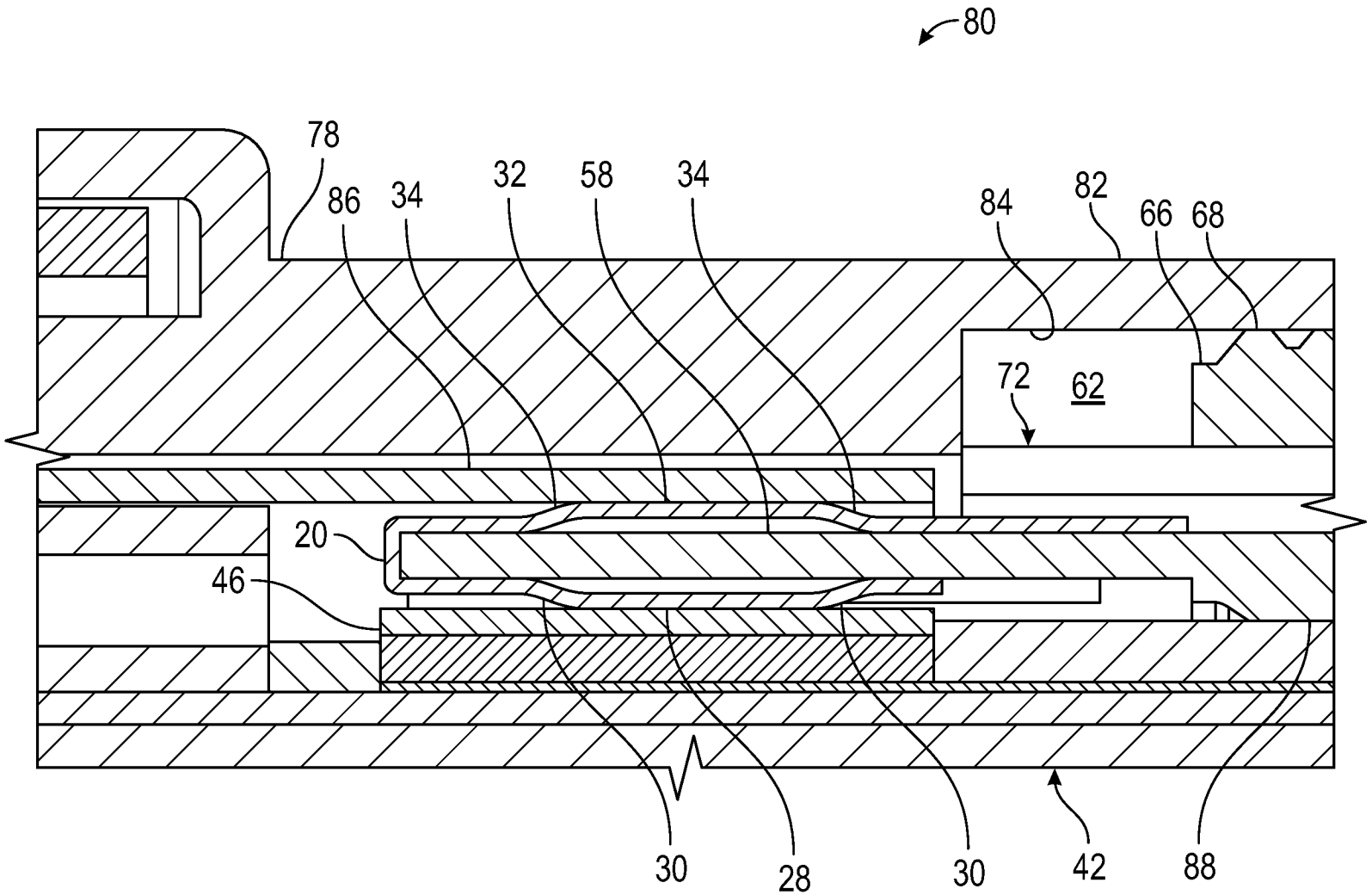
FIG. 6 is a schematic, cross section view, on an enlarged scale, of a portion of the cover assembly, cable assemblies and electrical connector, taken from encircled area 6 in FIG. 5.

Referring now to FIGS. 5 and 6, with reference to FIGS. 1-4, partial cross sections of the electrical connector 80 are shown. Where elements have already been discussed relative to FIGS. 1-4, the same element numbers will be used in FIGS. 5 and 6 without repeating the description thereof. The connector housing 78 may include an outer wall 82 that extends between the alignment flange 60 and the interface seal 66, compressing the sealing ribs 68, to seal the end of the connector housing 78 that telescopically receives the cover assembly 72. The connector housing 78 may also include retention features (e.g. a barb on a radially outer surface of the outer wall 82, not shown) that releasably engage the housing retention flanges 70 (shown in FIGS. 3 and 4) to releasably secure the cover assembly 72 to the connector housing 78. The outer wall 82 may also define a cable receiving cavity 84 into which a portion of the cover assembly 72 and cable assemblies 42 telescopically slide. Within the portions of the cable receiving cavity 84 into which respective cable assemblies 42 slide, connector shields 86 may be located. The connector shields 86 may be electrically conducting and generally annular-shaped, with each connector shield 86 sized to receive a pair of spring clips 20 therein.

The assembly of the cover assembly 72, cable assemblies 42 and the electrical connector 80 will now be discussed. Each cable assembly 42 is aligned to be telescopically inserted into a respective cable passage 62 of the cover assembly 72 (as shown in FIG. 3), and telescopically slid through its respective cable passage 62 until the respective ferrule 46 aligns with corresponding ferrule contacts 28 (as shown in FIGS. 4-6). The radially inner surfaces of the ferrule contacts 28 for corresponding pairs of spring clips 20 mounted in a particular cable passage 62 are closer together than a diameter of the corresponding ferrule 46, thus causing the curved portions 30 on either side of each ferrule contact 28 to elastically flex during assembly. This flexure causes each of the ferrule contacts 28 to be biased against its corresponding ferrule 46, thus assuring continuous surface contact and providing frictional resistance for maintaining the cable assemblies 42 in the cover assembly 72. The cable support walls 58 may also be shaped to provide a narrower cable passage 62, creating sealing flanges 88 adjacent to the interface seal 66, thus providing sealing between the outer insulation 44 and the cable support walls 58 and frictional resistance for maintaining the cable assemblies 42 in the cover assembly 72.

The cover assembly 72 may be assembled to the connector housing 78 by aligning the alignment flange 60 around the outer wall 82 and telescopically sliding the cover assembly 72 into the cable receiving cavity 84 until the housing retention flanges 70 engage the connector housing 78 (discussed above), with the sealing ribs 68 pressing against the outer wall 82 (discussed above). In the assembled position of the cover assembly 72 to the connector housing 78 (shown in FIGS. 5 and 6), the respective connector shield 86 aligns with connector shield contacts 32 of corresponding connector shields 86 (also shown in FIGS. 5 and 6). The radially outer surfaces of the connector shield contacts 32 for corresponding pairs of spring clips 20 mounted in a particular cable passage 62 are farther apart than the spacing of the corresponding connector shields 86, thus causing the curved portions 34 on either side of each connector shield contact 32 to elastically flex during assembly. This flexure causes each of the connector shield contacts 32 to be biased against its corresponding connector shield 86, thus assuring continuous surface contact.

Disassembly of the cable assemblies 42, cover assembly 72 and connector housing 78 is relatively quick and easy. Flexing of the housing retention flanges 70 while pulling the cover assembly 72 away from the connector housing 78 will remove the cover assembly 72 and cable assemblies 42 from the connector housing 78. This removal is relatively quick and easy since the cover assembly 72 is removed as one piece. Because the spring clips 20 maintain contact through a spring bias force, the cover assembly 72 may be removed, with each of the spring clips 20 rebounding to their unstressed shapes on the connector shield contact sides. The sealing ribs 68 of the interface seal 66 will also rebound to their unstressed positions. Additionally, since each spring clip 20 is fixed to the back cover 40 by the retention features 38, they will remain fixed to the back cover 40 in the proper positions for reassembly. Reinsertion of the cover assembly 72, then, will just cause the spring clips 20 to once again flex and maintain contact via spring bias.

Each of the cable assemblies 42 may be removed from the cover assembly 72 by pulling them telescopically out of the corresponding cable passages 62. Since the spring clips 20 maintain the contact through a spring bias force, the cable assemblies 42 may be removed, with each of the spring clips 20 rebounding to their unstressed shapes on the ferrule sides. Again, the spring clips 20 will remain fixed to the back cover 40 in their proper positions for reassembly. Reinsertion of the same or new cable assemblies 42, then, will just cause the spring clips 20 to once again flex and maintain contact via a spring bias.

The grounding path will now be discussed. With the cable assemblies 42, cover assembly 72, and electrical connector 80 assembled as shown in FIGS. 5 and 6, a grounding path for the shielding is continuous from each of the cable assemblies 42 through the electrical connector 80. The conductive cable shield 48 is in contact with the corresponding conductive ferrule 46, which is in surface contact with the ferrule contact 28 of the corresponding conductive spring clips 20. The ferrule contact 28 of the first leg 24 of each spring clip 20 is conductively connected to the connector shield contact 32 of the corresponding second leg 26 via the corresponding end stop 22. The connector shield contact 32 of each spring clip 20 is in surface contact with the corresponding conductive connector shield 86 of the electrical connector 80. Thus, a shielding and grounding path is maintained for the assembly, while still allowing for ease of assembly and disassembly.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

a housing defining a cable receiving cavity and including a conductive connector shield extending within a portion of the cavity; and a cover assembly having a back cover that includes an end wall that mates with the housing adjacent to the cable receiving cavity; a cable support wall extending from the end wall and defining a cable passage extending through the end wall, the cable support wall configured to receive a shielded cable therein; and a conductive spring clip fixed to the cable support wall having a first leg configured to be biased into contact with a conductive ferrule of the shielded cable and a second leg, on an opposed side of the cable support wall, spring biased into contact with the connector shield.

2. The electrical connector assembly of claim 1 wherein the second leg includes a connector shield contact portion between a pair of curved portions, the pair of curved portions being elastically flexed, spring biasing the connector shield contact portion into contact with the connector shield.

3. The electrical connector assembly of claim 2 wherein the first leg includes a ferrule contact portion between a second pair of curved portions, the second pair of curved portions configured to be elastically flexed to bias the ferrule contact portion into contact with the ferrule of the shielded cable.

4. The electrical connector assembly of claim 3 wherein the cable support wall includes clip retention arms and the spring clip includes a retention feature that is engaged with the clip retention arms to fix the spring clip to the cable support wall.

5. The electrical connector assembly of claim 2 wherein the cable support wall includes clip retention arms and the spring clip includes a retention feature that is engaged with the clip retention arms to fix the spring clip to the cable support wall.

6. The electrical connector assembly of claim 1 wherein the cable support wall includes clip retention arms and the spring clip includes a retention feature that is engaged with the clip retention arms to fix the spring clip to the cable support wall.

7. The electrical connector assembly of claim 1 wherein the first leg includes a ferrule contact portion between a pair of curved portions, the pair of curved portions configured to be elastically flexed to bias the ferrule contact portion into contact with the ferrule of the shielded cable.

8. The electrical connector assembly of claim 1 wherein the cover assembly includes a conductive second spring clip, spaced from the spring clip and fixed to the cable support wall, having a first leg configured to be biased into contact with the conductive ferrule of the shielded cable and a second leg, on an opposed side of the cable support wall, spring biased into contact with the connector shield.

9. The electrical connector assembly of claim 8 wherein the second legs of the spring clip and the second spring clip each include a connector shield contact portion between a pair of curved portions, with the pair of curved portions being elastically flexed, spring biasing the respective connector shield contact portion into contact with the connector shield.

10. The electrical connector assembly of claim 9 wherein the first legs of the spring clip and the second spring clip each include a ferrule contact portion between a second pair of curved portions, with the second pair of curved portions configured to be elastically flexed to bias the respective ferrule contact portions into contact with the ferrule of the shielded cable.

11. The electrical connector assembly of claim 10 wherein the cable support wall includes a first clip retention feature and a second clip retention feature, the first clip retention feature engaged with a clip retention feature of the spring clip to fix the spring clip to the cable support wall, and the second clip retention feature engaged with a second clip retention feature of the second spring clip to fix the second spring clip to the cable support wall.

12. The electrical connector assembly of claim 8 wherein the spring clip is spaced about 180 degrees circumferentially from the second spring clip such that the first leg of the second spring clip creates a bias force in an opposite direction from the bias force of the first leg of the second spring clip.

13. The electrical connector assembly of claim 8 wherein the first legs of the spring clip and the second spring clip each include a ferrule contact portion between a pair of curved portions, with the pair of curved portions configured to be elastically flexed to bias the respective ferrule contact portions into contact with the ferrule of the shielded cable.

14. The electrical connector assembly of claim 8 wherein the cable support wall includes a first clip retention feature and a second clip retention feature, the first clip retention feature engaged with a clip retention feature of the spring clip to fix the spring clip to the cable support wall, and the second clip retention feature engaged with a second clip retention feature of the second spring clip to fix the second spring clip to the cable support wall.

15. The electrical connector assembly of claim 1 wherein the cover assembly includes a second cable support wall extending from the end wall and defining a second cable passage extending through the end wall, the second cable support wall configured to receive a second shielded cable therein, and a conductive second spring clip fixed to the second cable support wall having a first leg configured to be biased into contact with a second conductive ferrule of the second shielded cable and a second leg, on an opposed side of the second cable support wall, spring biased into contact with the connector shield.

16. The electrical connector assembly of claim 1 wherein the cover assembly includes a seal affixed to the back cover and sealingly biased against the cable receiving cavity and configured to be sealingly biased against the shielded cable.

17. An electrical connector assembly comprising:

a housing defining a cable receiving cavity and including a conductive connector shield extending within a portion of the cavity;

a shielded cable having a conductive shield in contact with a conductive ferrule; and a cover assembly having a back cover that includes an end wall that mates with the housing adjacent to the cable receiving cavity; a cable support wall extending from the end wall and defining a cable passage extending through the end wall, the cable support wall receiving the shielded cable therein; and a conductive spring clip fixed to the cable support wall having a first leg biased into contact with the ferrule and a second leg, on an opposed side of the cable support wall, spring biased into contact with the connector shield.

18. The electrical connector assembly of claim 17 wherein the first leg includes a ferrule contact portion between a second pair of curved portions, the second pair of curved portions elastically flexed to bias the ferrule contact portion into contact with the ferrule.

19. The electrical connector assembly of claim 18 wherein the second leg includes a connector shield contact portion between a pair of curved portions, the pair of curved portions being elastically flexed, spring biasing the connector shield contact portion into contact with the connector shield.

20. The electrical connector assembly of claim 17 wherein the cable support wall includes clip retention arms and the spring clip includes a retention feature that is engaged with the clip retention arms to fix the spring clip to the cable support wall.

* * * * *